United States Patent [19]

Geenberghe

[11] 4,301,559

[45] Nov. 24, 1981

[54] SOFA BED MECHANISM

[76] Inventor: J. Van Geenberghe, Kortrijkstraat 246, Rue De Courtrai, 8610 Wevelgen, Belgium

[21] Appl. No.: 127,919

[22] Filed: Mar. 6, 1980

[51] Int. Cl.[3] ..... A47C 17/04; A47C 17/22

[52] U.S. Cl. ..... 5/13; 5/29; 5/31

[58] Field of Search ..... 5/13, 28, 29, 31, 37 R

[56] References Cited

U.S. PATENT DOCUMENTS

| | | | |
|---|---|---|---|
| 3,292,188 | 12/1966 | Gerth | 5/13 |
| 3,503,081 | 3/1970 | Mikos | 5/13 |
| 4,080,672 | 3/1978 | Eakins | 5/13 |
| 4,200,941 | 5/1980 | Gill et al. | 5/13 |

*Primary Examiner*—Roy D. Frazier
*Assistant Examiner*—Alexander Grosz
*Attorney, Agent, or Firm*—Olsen and Stephenson

[57] ABSTRACT

A sofa bed mechanism consisting of three sections, namely, a rear section, an intermediate section, and a front section, that are foldable between collapsed sofa positions in which the sections are in substantially horizontal vertically stacked positions and bed positions in which the sections extend in substantially horizontal alignment. A frame supports the sections, the frame being of minimum width by which is meant the frame is of a shallow dimension in a direction front to rear of the sofa. The sections are stacked on top of the frame in their sofa positions so that the frame and the sections present a compact substantially rectangular profile when viewed from the end of the frame, thereby allowing substantial flexibility in the design of the sofa in which the mechanism is mounted. The end sections are connected by hinge assemblies located entirely on the sides of the assemblies to avoid the necessity for any cross tubes that might interfere with sleeper comfort in the bed position of the mechanism.

9 Claims, 7 Drawing Figures

SOFA BED MECHANISM

BACKGROUND OF THE INVENTION

Figure 1:
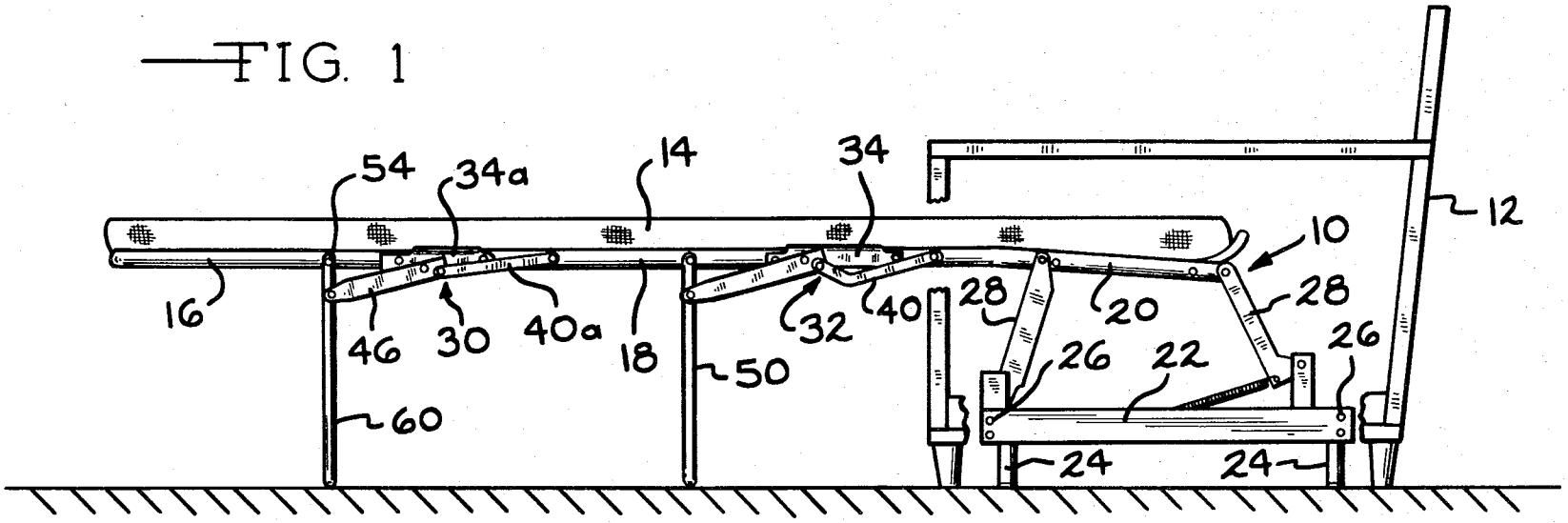

The structure and design of the furniture in which sofa bed mechanisms are embodied are limited by the size and arrangement of the mechanism around which the furniture must be built. Many prior sofa bed mechanisms have been large in width, namely, large in a direction front to rear of the furniture. Also, some mechanisms extend upwardly at the rear of the furniture requiring additional storage space in the furniture.

It is an object of this invention to provide an improved sofa bed mechanism which is of a shallow dimension in a direction front to rear of the sofa, has a low compact rectangular end profile and does not include any cross tubes that might interfere with sleeper comfort in the bed position of the mechanism. Such a mechanism is advantageous from the standpoint of furniture construction and design and also from the standpoint of sleeper comfort.

SUMMARY OF THE INVENTION

A sofa bed mechanism consisting of three sections, namely, a rear section, an intermediate section, and a front section, these sections being foldable between collapsed sofa positions in which the sections are in substantially horizontal positions and are stacked vertically and horizontally extended bed positions in which the sections extend in substantially horizontal alignment. A support frame for the sections is disposed beneath the stacked sections in their sofa positions and a linkage supports the rear section on the support frame so that the sections can readily be swung between their collapsed sofa positions to their extended bed positions.

A plurality of joint assemblies hingedly connect the sections together in order to provide for the necessary unfolding movement in which, when moving the sections from their bed positions to their sofa positions, the front section is first folded onto the intermediate section, following which the intermediate section, with the front section thereon, is folded onto the rear section so that in the resulting stack, the front section is sandwiched between the intermediate section and the rear section. The joint assemblies also function to maintain the bed frame sections in rigid alignment when in the extended bed positions. Each of the joint assemblies is disposed entirely to one side of the sections that are connected thereby. This avoids the necessity for any connecting tubes running across the sections that might interfere with sleeper comfort when the mechanism is in the bed position.

Each joint assembly is of simple construction and includes the same basic components. For example a front joint assembly consists of a hinge bar pivotally connected at its ends to the front and intermediate sections, a control link pivotally connected at one end to the intermediate section, and a locking link pivotally connected at one of its ends to the opposite end of the control link and pivotally connected intermediate its ends to the hinge bar. An easy to manipulate U-shape leg member that supports the front section on the floor in the bed forming position of the mechanism is pivotally connected at one end to the front section and a pin member pivotally connects the opposite end of the locking link to the leg member at a position spaced from the pivoted end of the leg a distance such that the leg member is movable about the pivot to a locking position in which the pin member is over center. This structure provides a toggle mechanism assuring that the sections are maintained in relatively folded positions during manipulation of the mechanism and during any expansion of the mattress that is compressed between the sections.

By virtue of the use of a three section mechanism, the supporting frame and the stacked sections can be constructed of a relatively narrow width, namely, a very shallow dimension in direction front to rear of the sofa. Furthermore, by virtue of the particular joint assemblies utilized in the mechanism of this invention, the sections can be relatively tightly folded so that the stacked sections and the supporting frame present a relatively low profile in the sofa position of the mechanism. The result is a compact mechanism which can readily be incorporated in sofa furniture of widely varying designs without any requirement for a wide sofa frame to accommodate the mechanism and without any requirement for a storage space at the rear of the seating area on the sofa. The particular joint assemblies also enable the elimination of the usual tubes that extend across the sofa bed sections underneath the mattress and which have a tendency to interfere with sleeper comfort.

The sofa bed mechanism of this invention thus achieves desirable objectives in a dual purpose furniture item that has traditionally been difficult to construct and assemble so that it is satisfactory both for seating and sleeping purposes.

Figure 2:
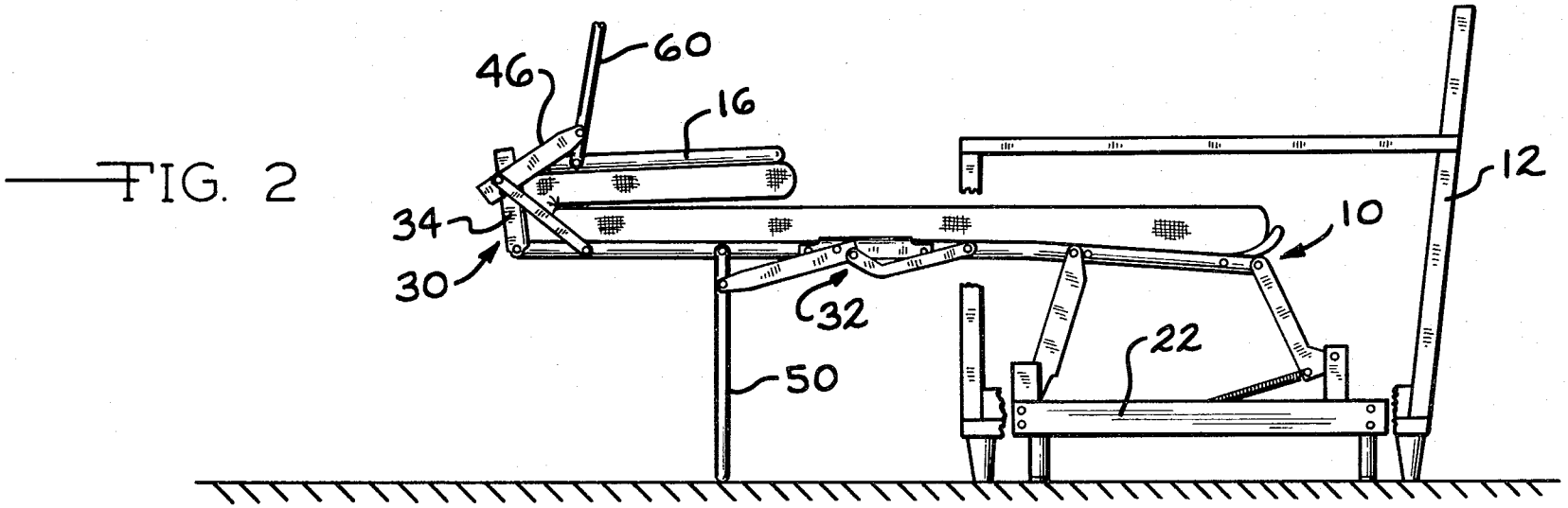
Figure 3:
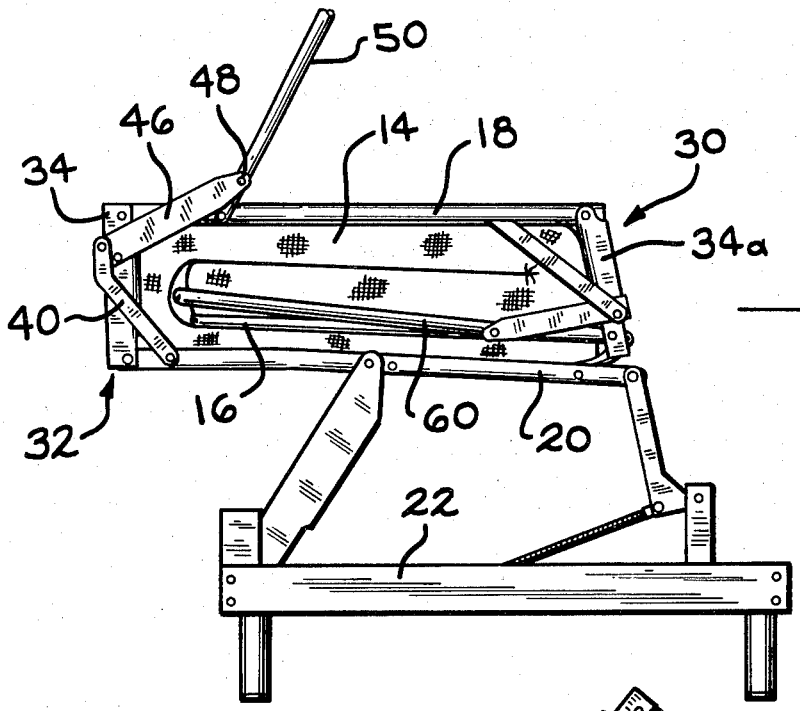
Figure 4:
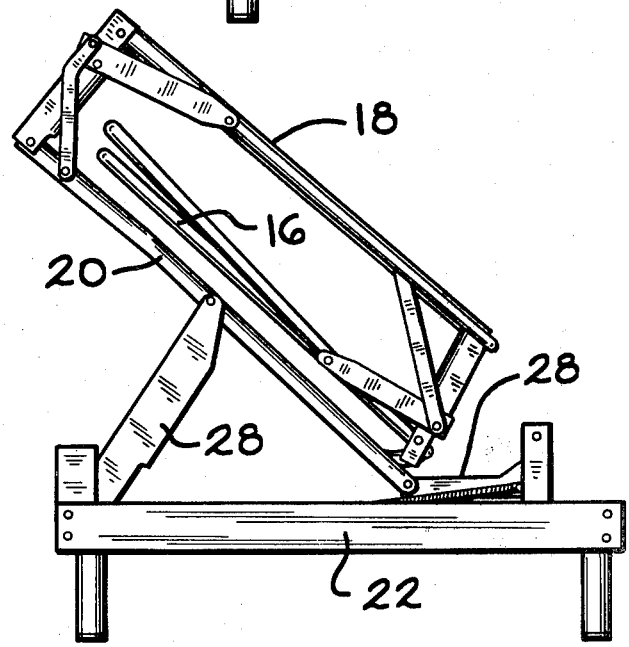
Figure 5:
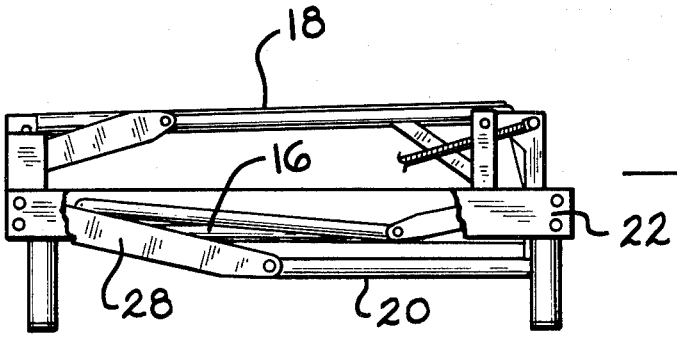
Figure 6:
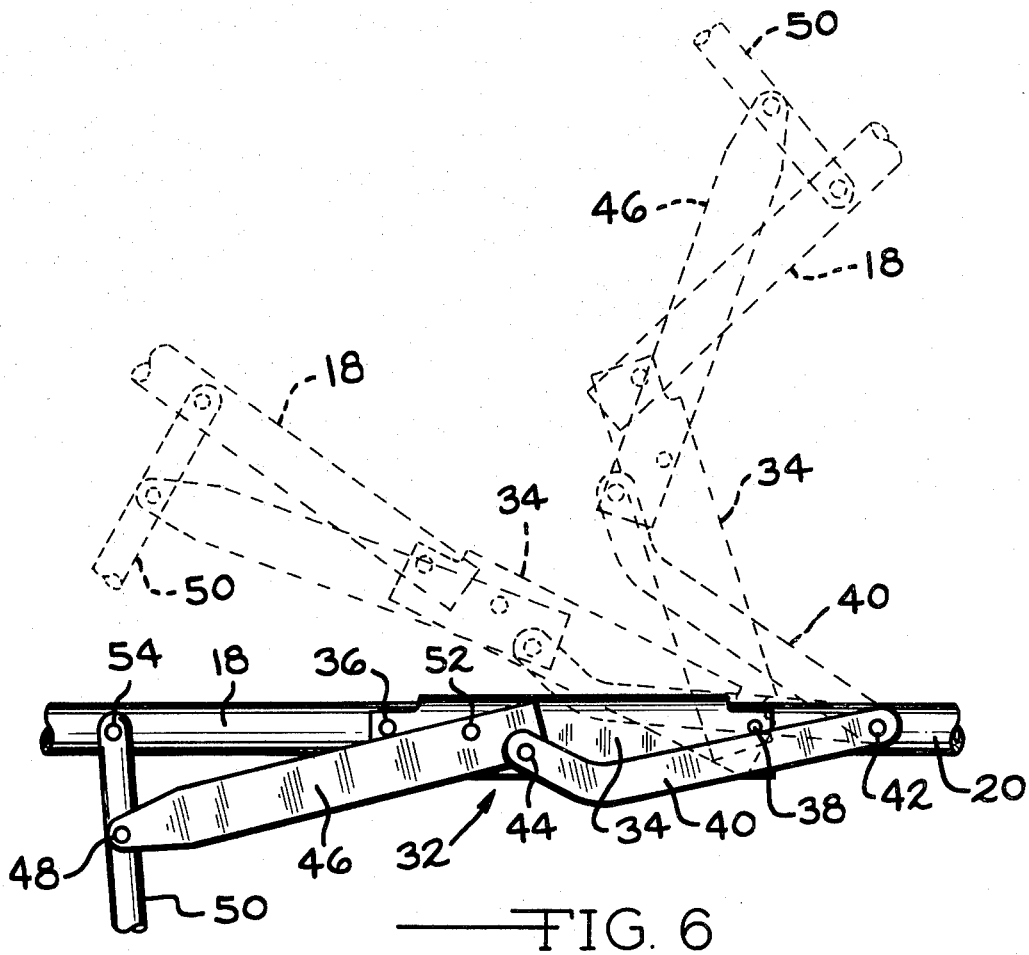
Figure 7:
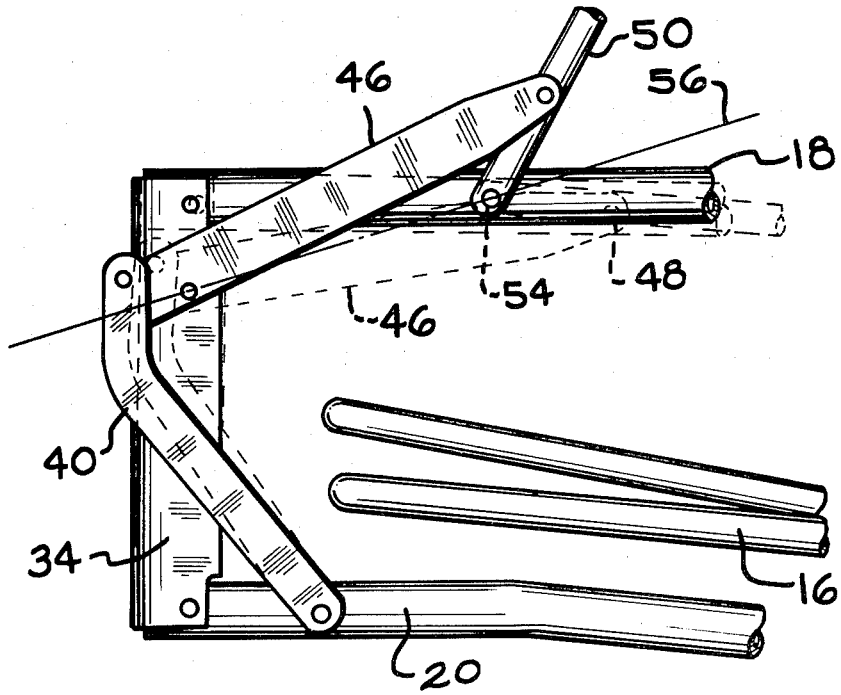

Further objects, features and advantages of this invention will become apparent from a consideration of the following description, the appended claims and the accompanying drawing in which:

FIGS. 1–5, inclusive, are end views of the sofa bed mechanism of this invention, illustrating the mechanism in successive positions as it is moved from its extended bed position shown in FIG. 1 to its collapsed sofa position shown in FIG. 5, an outline of the sofa frame being shown in FIGS. 1 and 2, and the mattress being eliminated from FIGS. 4 and 5 for the purpose of clarity;

FIG. 6 is a fragmentary side view of one of the joint assemblies in the sofa bed mechanism of this invention, showing the assembly in broken lines in successive positions as the assembly is moved toward a folded position; and FIG. 7 is a fragmentary side view of the joint assembly of FIG. 6 showing the assembly in its fully folded position in solid lines and showing the assembly in its locked position in broken lines.

With reference to the drawing, the sofa bed mechanism of this invention, indicated generally at 10, is illustrated in FIG. 1 in its bed forming position in which it extends forwardly from a sofa frame 12 and provides a firm support for a generally horizontally disposed mattress 14. The mechanism 10 consists of three relatively foldable metal framework sections, namely, a front section 16, an intermediate section 18, and a rear section 20. The mechanism also includes a support frame 22 having legs 24 that enable it to be floor supported within the frame 12 and having mounting bolts 26 which enable it to be secured to the ends of the frame 12 so that the frames 12 and 22 will be maintained in fixed relative positions. Support links 28 pivotally support the rear section 20 of the mechanism 10 on the frame 22 so that the section 20 can readily be swung between its bed position shown in FIG. 1 and its sofa position shown in FIG. 5.

The mechanism 10 also includes a pair of front hinge assemblies 30 disposed on opposite sides of the front and intermediate sections 16 and 18, and only one of which is shown in FIG. 1. The mechanism 10 further includes a pair of rear hinge assemblies 32 which hingedly connect the sections 18 and 20 and are disposed on opposite sides thereof, only one assembly 32 being shown in FIG. 1. Since the hinge assemblies 30 and 32 are substantially identical, only the hinge assembly 32 will be described in detail hereinafter.

Referring to FIG. 6, the hinge assembly 32 includes a hinge bar 34 which is connected at its front by a pivot pin 36 to the intermediate section 18 and at its rear end is connected by a pivot 38 to the rear section 20. A control link 40 is connected at one end by a pivot 42 to the section 20 and at its opposite end by a pivot 44 to one end of a locking link 46. The opposite end of the link 46 is connected by a pivot member 48 to a support leg 50 which, in the bed position of the section 18, provides a floor support for the section 18 as shown in FIG. 1. The leg 50 is of conventional U-shape being connected at its ends by pivot pins 54, only one of which is shown, to the frame 18. Adjacent the pivot 44, the locking link 46 is connected by a pivot 52 to the hinge bar 34.

In folding the intermediate section 18 onto the rear section 20, the section 18 and the hinge bar 34 are moved upwardly through the successive dotted line positions illustrated in FIG. 6 to the solid line position shown in FIG. 7 in which the sections 18 and 20 are in substantially horizontal parallel positions with the section 18 folded on top of the section 20. In this position, the hinge bar 34 is substantially upright. The support leg 50 extends upwardly and to the right, as shown in FIG. 7, and the locking link 46 is similarly inclined upwardly and to the right.

The U-shape supporting leg 50 is then manually swung downwardly about its pivot connection 54 to the intermediate section 18 to the broken line position shown in FIG. 7 in which the pivot member 48 is moved past a line 56 that extends through the pivot members 52 and 54 to the over-center position shown in FIG. 7 in which the pivot 48 is substantially below the line 56. This overcenter position of the locking link 46 prevents the sections 18 and 20 from being inadvertently unfolded and prevents the mattress 14 which is folded and compressed between the sections 18 and 20 from expanding and causing undesirable unfolding movement of the section 18 relative to the section 20.

It is to be noted that the joint assemblies 32 are disposed entirely to the sides of the connected sections 18 and 20, thereby avoiding the necessity for any connecting tubes or the like running side to side between the sections 18 and the sections 20 at positions below the mattress 14. Such tubes are very undesirable from the standpoint of user comfort when the mattress 14 is in its bed position.

The joint assemblies 30 are substantially identical to the assemblies 32. Accordingly, only the principal differences in the assembly 30 with respect to the assembly 32 will be described in detail. Like numerals indicate like parts in the assemblies 30 and 32 and the suffix "a" on numbered parts in the assembly 30 indicates parts different from the correspondingly numbered parts in the assembly 32. In the assembly 30, the hinge bar **34*a* is shorter than the corresponding hinge bar 34 in the joint assembly 32 because the joint assembly 30 needs to accommodate only two thicknesses of the mattress 14 while the joint assembly 32 needs to accommodate three thicknesses. For the same reason, the control line 40*a* in the assembly 30 is shorter and is shaped differently from the control link 40 in the assembly 32. In the assembly 30, the locking link 46 is pivotally connected to a U-shape supporting leg 60 for the front section 16 like the leg 50 which supports the section 18**.

In the operation of the mechanism 10, assume that the sections 16, 18, and 20 are in their horizontally extended bed positions shown in FIG. 1 and that it is desired to fold the sections 16, 18 and 20 to the collapsed sofa position shown in FIG. 5. The section 16 is first moved upwardly and rearwardly to a folded position with respect to the intermediate section 18, as illustrated in FIG. 2. The U-shape leg 60 is then moved clockwise from its FIG. 2 position to an over-center position for the pivot member 48, as shown in broken line in FIG. 7 so as to lock the joint assemblies 30 in positions in which the sections 16 and 18 are maintained in folded positions.

The intermediate section 18, with the front section 16 folded over on it, as shown in FIG. 2, is then manually swung upwardly and rearwardly to its folded position on the rear section 20. This is illustrated in FIG. 3 in which it is shown that the front section 16 is disposed in a sandwich between the sections 18 and 20. With the U-shape supporting leg 50 extending upwardly, as shown in FIG. 3, the leg 50 is then swung downwardly to the overcenter position for the pivot member 48 shown in FIGS. 4 and 7 to lock the section 18 in its folded position on the section 20. The folded sections 16, 18 and 20 are then moved downwardly through the successive positions illustrated in FIGS. 4 and 5 to the fully folded sofa position illustrated in FIG. 5.

In the folded positions of the sections 16, 18 and 20 shown in FIG. 5, it is seen that the sections are generally horizontal and are in a superposed relation. When taken together with the frame 22, the mechanism sections form a compact generally rectangular profile when viewed from the end. This rectangular profile has no projections and, as a result, enables the furniture manufacturer to incorporate the mechanism 10 in sofa frames 12 of a wide variety of designs and structures. This is highly desirable from the standpoint of the furniture manufacturers. By virtue of the fact that the mattress 14 is folded into three sections corresponding to the sections 16, 18 and 20, the rectangular profile shown in FIG. 5 is very shallow in a direction front to rear of the sofa frame 12. This is also very desirable from the standpoint of the furniture manufacturer because it enables the furniture manufacturer to make relatively shallow frames 12 and assemble those frames 12 with satisfactory mechanisms 10. The hinge assemblies 30 and 32 not only provide for an improved mechanism 10 which is readily movable between the bed and sofa position shown in FIGS. 1 and 5, respectively, but since they constitute the sole connections between the sections 16, 18 and 20, they also eliminate any necessity for any connecting tubes between the sides of the frames 16, 18 and 20 that would underlie the mattress 14 and interfere with the comfort of the mattress user when the mattress 14 is in its bed position shown in FIG. 1. The hinge assemblies 30 and 32 are simple to construct, effective to maintain the bed frame sections in rigid alignment in their bed positions, and reliably lock the sections in their folded sofa positions.

What is claimed:

1. In a sofa bed assembly, a mechanism comprising a plurality of sections including in succession a rear section, an intermediate section, and a front section, said section being foldable between collapsed sofa position in which the sections are in substantially horizontal superposed relation in which said front section is sandwiched between said rear and intermediate sections and a horizontally extended bed position in which said sections extend in substantially horizontal alignment, a support frame for said sections disposed beneath said superposed sections in said sofa position, said support frame being of predetermined width, said superposed sections forming a sandwich unit of a width not exceeding said predetermined width, and means movably supporting said rear section on said support frame.

2. A sofa bed mechanism according to claim 1 further including joint assemblies hingedly connecting said sections to provide for said folding movement, said joint assemblies providing the sole connection between said sections and being located entirely to the sides of said assemblies whereby to avoid connections running side-to-side in said sections which would interfere with sleeper comfort in said bed position of the mechanism.

3. A sofa bed mechanism according to claim 2 wherein each of said joint assemblies is operatively associated with a leg member capable of providing support for said mechanism in the bed position thereof and capable of locking the joint assemblies in a folded position in the collapsed sofa positions of said sections.

4. In a sofa bed assembly, a mechanism comprising a plurality of sections including in succession a rear section, an intermediate section, and a front section, said sections being foldable between a collapsed sofa position in which the sections are in substantially horizontal superposed relation and a horizontally extended bed position in which said sections extend in substantially horizontal alignment, a support frame for said sections disposed beneath said superposed sections in said sofa position, means supporting said rear section on said support frame, first connecting joint means pivotally supporting said front section on said intermediate section so that said front section is hingedly movable between said bed position and a folded position on top of said intermediate section, a supporting leg for said front section operatively associated with said first connecting joint means so that manipulation of said supporting leg is operable to lock said front section in a relatively folded, substantially parallel relation with said intermediate section, second connecting joint means pivotally supporting said intermediate section on said rear section so that said intermediate section with said front section superposed thereon is movable to a folded position on top of said rear section, and a supporting leg for said intermediate section operatively associated with said second connecting joint means so that manipulation of said supporting leg is operable to lock said intermediate section in a relatively folded, substantially parallel relation with said rear section.

5. A sofa bed mechanism according to claim 4 wherein said support frame is of a predetermined width, each of said sections in the collapsed sofa positions thereof being of a width that does not exceed said predetermined width.

6. A sofa bed mechanism according to claim 4 wherein said connecting joint means provide for a vertically stacked arrangement of said sections in the collapsed sofa positions thereof in which said front section is sandwiched between said intermediate and rear sections and said sections are within the dimensional confines of said frame in the front to rear direction of said frame.

7. In a sofa bed assembly, a mechanism comprising a plurality of sections including in succession a rear section, an intermediate section, and a front section, said sections being foldable between collapsed sofa position in which the sections are in substantially horizontal superposed relation and a horizontally extended bed position in which said sections extend in substantially horizontal alignment, a support frame for said sections disposed beneath said superposed sections in said sofa position, linkage means pivotally supporting said rear section on said support frame, connecting joint means pivotally supporting said front section on said intermediate section and pivotally supporting said intermediate section on said rear section, each said joint means comprising a hinge bar pivotally connected at its ends to the connected sections, a control link pivotally connected at one end to the supporting one of said sections, a locking link pivotally connected at one of its ends to the opposite end of said control link and pivotally connected intermediate its ends to said hinge bar, a supporting leg member pivotally connected at one end to the supported one of said sections and pin means pivotally connecting the opposite end of said locking link to said leg member at a position spaced from said one leg end a distance such that said leg member is movable about said one end pivot to a locking position in which said pin means is below a line extending through the pivotal connections of said locking link to said hinge bar and said supported section to said supporting leg, whereby said supporting leg will maintain said locking link in a position precluding movement of said supported section in a direction away from said supporting section.

8. A sofa bed mechanism according to claim 7 wherein said support frame is of a predetermined width, each of said sections in the collapsed sofa positions thereof being of a width that does not exceed said predetermined width.

9. A sofa bed mechanism according to claim 7 wherein said connecting joint means provide for a vertically stacked arrangement of said sections in the collapsed sofa positions thereof in which said front section is sandwiched between said intermediate and rear sections and said sections are within the dimensional confines of said frame in the front to rear direction of said frame.

* * * * *